US006933665B2

(12) United States Patent
Gilton et al.

(10) Patent No.: US 6,933,665 B2
(45) Date of Patent: Aug. 23, 2005

(54) STRUCTURE AND METHOD FOR FIELD EMITTER TIPS

(75) Inventors: Terry L. Gilton, Boise, ID (US); Paul A. Morgan, Kuna, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/193,016

(22) Filed: Jul. 9, 2002

(65) Prior Publication Data

US 2002/0175608 A1 Nov. 28, 2002

Related U.S. Application Data

(62) Division of application No. 09/261,477, filed on Feb. 26, 1999, now Pat. No. 6,417,016.

(51) Int. Cl.[7] ..... H01J 1/05

(52) U.S. Cl. ..... 313/311; 313/309; 313/310; 313/351; 438/20; 445/50; 445/51; 445/24

(58) Field of Search ..... 438/20; 445/50; 313/309, 310, 311, 336, 351, 495

(56) References Cited

U.S. PATENT DOCUMENTS

| | | | | |
|---|---|---|---|---|
| 3,665,241 A | | 5/1972 | Spindt et al. | 313/351 |
| 3,755,704 A | | 8/1973 | Spindt et al. | 313/309 |
| 3,812,559 A | | 5/1974 | Spindt et al. | 29/25.18 |
| 5,186,670 A | | 2/1993 | Doan et al. | 445/24 |
| 5,229,331 A | | 7/1993 | Doan et al. | 437/228 |
| 5,229,682 A | | 7/1993 | Komatsu | 313/309 |
| 5,259,799 A | | 11/1993 | Doan et al. | 445/24 |
| 5,358,908 A | | 10/1994 | Reinberg et al. | 437/228 |
| 5,372,973 A | | 12/1994 | Doan et al. | 437/228 |
| 5,401,676 A | | 3/1995 | Lee | 437/200 |
| 5,458,518 A | * | 10/1995 | Lee | 445/24 |
| 5,564,958 A | | 10/1996 | Itoh et al. | 445/6 |
| 5,578,902 A | * | 11/1996 | Vickers | 313/496 |
| 5,597,444 A | | 1/1997 | Gilton | 156/643.1 |
| 5,608,283 A | * | 3/1997 | Twichell et al. | 313/309 |
| 5,627,427 A | | 5/1997 | Das et al. | 313/308 |
| 5,666,020 A | | 9/1997 | Takemura | 313/306 |
| 5,672,938 A | * | 9/1997 | Jones | 313/504 |
| 5,769,679 A | | 6/1998 | Park et al. | 445/50 |
| 5,844,250 A | | 12/1998 | Itoh et al. | 257/10 |
| 5,853,492 A | | 12/1998 | Cathey et al. | 134/3 |
| 5,857,885 A | | 1/1999 | Laou et al. | 445/24 |
| 5,898,258 A | | 4/1999 | Sakai et al. | 313/309 |
| 5,910,791 A | | 6/1999 | Zimlich et al. | 345/74 |

(Continued)

OTHER PUBLICATIONS

Anderson, R.C. ,et al. , "Porous Polycrystalline Silicon: A New Material for MEMS", *IEEE,* (1994), pp. 10–18.

Boswell, E..C. ,et al. , "Polycrystalline Silicon Field Emitters", *8th International Vacuum Microelectronics Conference Technical Digest,* (1996),pp. 181–185.

Boswell, E..C. ,et al. , "Polycrystalline Silicon Field Emitters", *J. Vac. Sci. Technol. B* 14 (3), (1996),pp. 1910–1913.

*Primary Examiner*—Edward J. Glick
*Assistant Examiner*—Elizabeth Keaney
(74) *Attorney, Agent, or Firm*—Schwegman, Lundberg, Woessner & Kluth, P.A.

(57) ABSTRACT

Improved methods and structures are provided for an array of vertical geometries which may be used as emitter tips, as a self aligned gate structure surrounding field emitter tips, or as part of a flat panel display. The present invention offers controlled size in emitter tip formation under a more streamlined process. The present invention further provides a more efficient method to control the gate to emitter tip proximity in field emission devices. The novel method of the present invention includes implanting a dopant in a patterned manner into the silicon substrate and anodizing the silicon substrate in a controlled manner causing a more heavily doped region in the silicon substrate to form a porous silicon region.

23 Claims, 7 Drawing Sheets

U.S. PATENT DOCUMENTS

| | | | | | |
|---|---|---|---|---|---|
| 5,956,611 | A | | 9/1999 | Cathey, Jr. et al. | 438/630 |
| 5,973,444 | A | * | 10/1999 | Xu et al. | 313/309 |
| 6,008,063 | A | | 12/1999 | Derraa | 438/20 |
| 6,028,322 | A | | 2/2000 | Moradi | 257/10 |
| 6,080,032 | A | | 6/2000 | Alwan | 445/50 |
| 6,194,826 | B1 | | 2/2001 | Satou et al. | 313/485 |
| 6,232,705 | B1 | | 5/2001 | Forbes et al. | 313/309 |
| 6,297,587 | B1 | * | 10/2001 | Kikuchi et al. | 313/495 |
| 6,323,587 | B1 | | 11/2001 | Zhang et al. | 313/309 |

OTHER PUBLICATIONS

Huang, W..N. ,et al. , "Photoluminescence in porous sputtered polysilicon films formed by chemical etching", *Semicond. Sci. Technol., 12,* (1997),pp. 228–233.

Huang, W..N. , et al. , "Properties of chemically etched porous polycrystalline silicon deposited by r.f. sputtering", *IEEE Hong Kong Electron Devices Meeting,* (1996), pp. 21–24.

Huq, S..E. ,et al. , "Comparative study of gated single crystal silicon and polysilicon field emitters", *J. Vac. Sci. Technol. B* 15 (6), (1997),pp. 2855–2858.

Huq, S..E. ,et al. , "Fabrication of Gated Polycrystalline Silicon Field Emitters", *9th International Vacuum Microelectrics Conference,* St. Petersburg,(1996),pp. 367–370.

Kim, I..H. , et al. , "Fabrication of metal field emitter arrays on polycrystalline silicon", *J. Vac. Sci. Technol. B* 15 (2), (1997),pp. 468–471.

Kim, H..,et al. , "Metal FEA's on Double Layer Structure of Polycrystalline Silicon", *9th International Vacuum Microelectronics Conference,* St. Petersburg,(1996), pp. 423–426.

Lazarouk, S..,et al. , "Electrical characterization of visible emitting electroluminescent Schottky diodes based on n–type porous silicon and on highly doped n–type porous polysilicon", *Journal of Non–Crystalline Solids,* (1996),pp. 973–976.

Lee, J..H. ,et al. ,"A New Fabrication Method of Silicon Field Emitter Array with Local Oxidation of Polysilicon and Chemical–Mechanical–Polishing", *9th International Vacuum Microelectronics Conference,* St. Petersburg, (1996),pp. 415–418.

Pullen, S..E. ,et al. , "Enhanced Field Emission from Polysilicon Emitters Using Porous Silicon", *9th International Vacuum Microelectronics Conference,* St. Petersburg, (1996),pp. 211–214.

Uh, H..S. , et al. , "Enhanced Electron Emission and Its Stability from Gated Mo–polycide Field Emitters", *IEEE,* (1997),pp. 713–716.

Uh, H..S. , et al. , "Fabrication and Characterization of Gated n Polycrystalline Silicon Field Emitter Arrays", *9th International Vacuum Microelectronics Conference,* St. Petersburg,(1996), pp. 419–422.

Uh, H..S. ,et al. ,"Process design and emission properties of gated n polycrystalline silicon field emitter arrays for flat–panel display applications", *J. Vac. Sci. Technol. B* 15 (2), (1997),pp. 472–476.

* cited by examiner

STRUCTURE AND METHOD FOR FIELD EMITTER TIPS

This application is a Divisional of U.S. application Ser. No. 09/261,477, filed Feb. 26, 1999, now U.S. Pat. No. 6,417,016, which is incorporated herein by reference.

CO-PENDING APPLICATION

The following commonly assigned application Ser. No. 09/144,207, filed on Sep. 1, 1998, now U.S. Pat. No. 6,232,705 is noted.

FIELD OF THE INVENTION

The present invention relates generally to semiconductor integrated circuits. More particularly, it pertains to a structure and method for improved field emitter arrays.

BACKGROUND OF THE INVENTION

Recent years have seen an increased interest in field emitter displays. This is attributable to the fact that such displays can fulfill the goal of hang-on-the-wall flat panel television displays with diagonals in the range of 20 to 60 inches, among other uses. Such other uses include lap top computer display screens and instrument panel displays to mention a few applications. Some field emitter displays, or flat panel displays, operate on the same physical principle as fluorescent lamps. An emitted electron excites a gas discharge generates ultraviolet light (photons). The ultraviolet light then imparts energy to a phosphor which re-emits visible light.

Other field emitter displays operate on the same physical principals as cathode ray tube (CRT) based displays. Excited electrons are guided to a phosphor target which excite the phosphor directly. The phosphor then emits photons in the visible spectrum. Silicon substrate field emitter arrays are one source for creating similar displays. Both type methods of operation for field emitter displays rely on an array of field emitter tips.

Silicon substrate field emitter arrays have been previously described for flat panel field emission displays. Application of silicon substrate field emitter arrays into large area manufacture for use in large size displays presents costly and lengthy processing requirements. Typical silicon field emitter arrays have only been produced according to lengthy, conventional, integrated circuit technology, e.g., by masking silicon substrates and then either etching or oxidizing to produce cones of silicon with points for field emitters. The cones of silicon can then be utilized directly or undergo further processing to cover the points with some inert metal or low work function material.

Another problem with silicon based field emitter processing involves emitter tip to gate distance. The resolution of a field emission display is a function of a number of factors, including emitter tip sharpness, alignment and spacing of the gates, or grid openings, which surround the tips. This distance partly determines the turn-on voltage, the voltage difference required between the tip and the grid to start emitting electrons. Typically, the smaller the distance, the lower the turn-on voltage for a given field emitter, and hence lower power dissipation. A low turn-on voltage also improves the beam optics and the speed at which the display can change. Thus it is desirable to minimize the emitter tip to gate distance in the development of field emission devices (FED).

There are numerous methods to fabricate FEDs. One such popular technique in the industry includes the "Spindt" method, named after an early patented process. Spindt, et. al. discuss field emission cathode structures in U.S. Pat. Nos. 3,665,241, 3,755,704, and 3,812,559. Generally, the Spindt technique entails the conventional steps of masking insulator layers and then includes lengthy etching, oxidation, and deposition steps. In the push for more streamlined fabrication processes, the Spindt method is no longer the most efficient approach. Moreover, the Spindt process does not resolve or necessarily address the problem of gate to emitter tip distance.

The emitter tip to gate spacing is generally determined by the thickness of the dielectric layer in place between the two. One method of achieving a smaller emitter tip to gate distance is to deposit a thinner dielectric, or insulator layer. However, this approach has the negative consequence of increasing the capacitance between the gate and substrate regions. In turn, the increased capacitance increases the response time of the field emission device.

A more recent technique includes the use of chemical mechanical planarization (CMP) and an insulator reflow step. One such method is presented in U.S. Pat. No. 5,229,331, entitled "Method to Form Self-Aligned Gate Structures Around Cold Cathode Emitter Tips Using Chemical Mechanical Polishing Technology," which is assigned to the same assignee as the present invention. Unfortunately, an insulator reflow process generally involves the use of an extra processing step to lay down an extra insulator layer. Also, the typical reflow dielectric materials employed, e.g., borophosphorus silicate glass (BPSG), require high processing temperatures to generate the reflow. This fact negatively impacts the thermal budget available in the fabrication sequence.

Thus, it is desirable to develop a controlled size in emitter tip formation in a more streamlined process. Further, what is needed is a more efficient method to control the gate to emitter tip proximity in self aligned structures.

SUMMARY OF THE INVENTION

The above mentioned problems with field emitter arrays and other problems are addressed by the present invention and will be understood by reading and studying the following specification. Structures and methods are described which accord improved benefits.

Improved methods and structures are provided for an array of vertical geometries which may be used as emitter tips, as a self aligned gate structure surrounding field emitter tips, or as part of a flat panel display. The present invention offers controlled size in emitter tip formation under a more streamlined process. The present invention further provides a more efficient method to control the gate to emitter tip proximity in field emission devices. The novel method of the present invention includes implanting a dopant in a patterned manner into the silicon substrate and anodizing the silicon substrate in a controlled manner causing a more heavily doped region in the silicon substrate to form a porous silicon region. In one embodiment, implanting the dopant in a patterned manner includes forming a patterned mask to define the geometry of less heavily doped regions. Controlling the anodization of the silicon substrate further regulates and defines the shape to less heavily doped regions in the silicon substrate which form vertical geometries that can be used as emitter tips. In one embodiment, anodizing the silicon substrate provides the vertical geometries with a textured surface.

One method of the present invention provides a self-aligned gate structure around emitter tips. Another method includes forming a field emission device. The present invention includes a novel field emitter array, self aligned gate structure, field emission device, and flat panel display all formed according to the methods provided in this application.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1A:
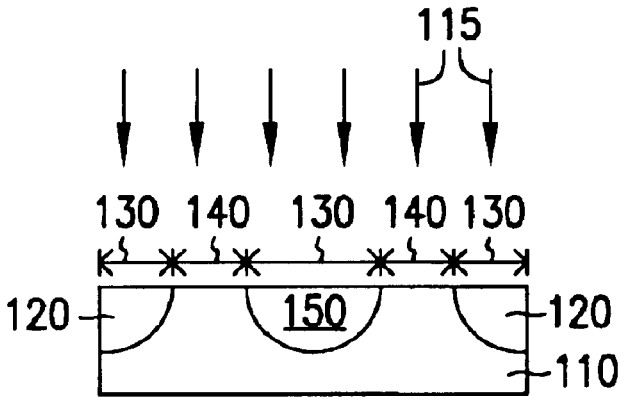
FIGS. 1A–1D illustrate an embodiment of a process of fabrication of a field emitter device according to the teachings of the present invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The terms wafer and substrate used in the following description include any structure having an exposed surface with which to form the integrated circuit (IC) structure of the invention. The term substrate is understood to include semiconductor wafers. The term substrate is also used to refer to semiconductor structures during processing, and may include other layers that have been fabricated thereupon. Both wafer and substrate include doped and undoped semiconductors, epitaxial semiconductor layers supported by a base semiconductor or insulator, as well as other semiconductor structures well known to one skilled in the art. The term conductor is understood to include semiconductors, and the term insulator is defined to include any material that is less electrically conductive than the materials referred to as conductors. The following detailed description is, therefore, not to be taken in a limiting sense, and the scope of the present invention is defined only by the appended claims, along with the full scope of equivalents to which such claims are entitled.

The term "horizontal" as used in this application is defined as a plane parallel to the conventional plane or surface of a wafer or substrate, regardless of the orientation of the wafer or substrate. The term "vertical" refers to a direction perpendicular to the horizonal as defined above. Prepositions, such as "on", "side" (as in "sidewall"), "higher", "lower", "over" and "under" are defined with respect to the conventional plane or surface being on the top surface of the wafer or substrate, regardless of the orientation of the wafer or substrate.

In particular, an illustrative embodiment of the present invention includes a method for forming vertical geometries on a silicon substrate. The method includes implanting a dopant in a patterned manner into the silicon substrate. Implanting the dopant in a patterned manner includes defining a more heavily doped region in the silicon substrate surrounding a number of less heavily doped regions. The silicon substrate is then anodized causing the more heavily doped region to form a porous silicon region. In one embodiment the anodization period is controlled to further regulate a shape and size for the number of less heavily doped regions. The method includes oxidizing the porous silicon region to form an oxidized porous silicon region. The oxidized porous silicon region is then removed.

Another embodiment of the present invention includes forming pillars of silicon. This method includes forming a patterned mask on a silicon substrate. Forming the patterned mask includes defining a number of pillar regions. A dopant is implanted into the silicon substrate surrounding the number of pillar regions such that the silicon substrate has a more heavily doped region. The silicon substrate is anodized causing the more heavily doped region to form a porous silicon region. In one exemplary embodiment, anodizing the silicon substrate includes reducing a size for the number of pillar regions underneath the patterned mask. The porous silicon region is oxidized to form an oxidized porous region and then the oxidized porous region is removed.

Another embodiment of the present invention includes forming an array of field emitter tips. This method includes implanting a dopant in a patterned manner into a silicon substrate to define a more heavily doped region in the silicon substrate surrounding a number of less heavily doped emitter tip regions. The silicon substrate is anodized causing the more heavily doped region to form a porous silicon region and defining a shape for the number of less heavily doped emitter tip regions. The porous silicon region is oxidized to form an oxidized porous silicon region and then the oxidized porous silicon region is removed.

An alternate method embodiment for the present invention includes forming a self-aligned gate structure around emitter tips. This embodiment includes forming a patterned mask on a silicon substrate to define a number of emitter tip regions. The method includes implanting a dopant into the silicon substrate to define a more heavily doped region surrounding the number of emitter tip regions. The method includes anodizing the silicon substrate to form a porous silicon region. In one exemplary embodiment, anodizing the silicon substrate includes further regulating a shape for the number of less heavily doped emitter tip regions. The porous silicon region is oxidized to form an oxidized region. A gate layer is then formed over the oxidized region and the patterned mask. In one exemplary embodiment, forming a gate layer over the oxidized region and the patterned mask includes removing a portion of the oxidized region such that a top surface layer of the oxidized region is below a bottom surface of the patterned mask.

An embodiment of the present invention also includes a forming a field emission device by implanting a dopant in a patterned manner into a silicon substrate. Implanting the dopant in a patterned manner includes defining a more heavily doped region in the silicon substrate surrounding a number of less heavily doped emitter tip regions. This method includes anodizing the silicon substrate and controlling the anodization period. Controlling the anodization period includes regulating a shape on each of the number of emitter tip regions. Anodizing the silicon substrate causes the more heavily doped region to form a porous silicon region. The porous silicon region is oxidized to form an oxidized porous silicon region. A patterned gate layer over the oxidized porous silicon region.

An apparatus embodiment for the present invention includes an emitter tip array. The emitter tip array has a number of vertical geometries on a silicon substrate. The number of vertical geometries are formed by implanting a dopant in a patterned manner into a silicon substrate. The patterned implant defines a more heavily doped region in the silicon substrate surrounding a number of less heavily doped emitter tip regions. The number of less heavily doped emitter tip regions are reduced by anodizing the silicon substrate. Also, anodizing the silicon substrate causes the more heavily doped region to form a porous silicon region. The porous silicon region is oxidized to form an oxidized porous silicon region which is then removed.

Another apparatus embodiment includes a self aligned gate structure surrounding field emitter tips. The self aligned gate structure surrounding field emitter tips includes a number of emitter tips created by forming a patterned mask on a silicon substrate. Forming the patterned mask includes defining a number of emitter tip regions. A dopant is implanted into the silicon substrate which then defines a more heavily doped region in the silicon substrate surrounding the number of emitter tip regions. The silicon substrate is anodized causing the more heavily doped region to form a porous silicon region and reducing a size for the number of emitter tip regions. The porous silicon region is oxidized to form an oxidized region and a gate layer is formed on the oxidized region. In one embodiment, the gate layer is formed on the oxidized region according to the following steps. A portion of the oxidized region is removed such that a top surface layer of the oxidized region is below a bottom surface of the patterned mask. A conductive layer is formed on the oxidized porous silicon region and the patterned mask. A portion of the conductive layer is removed to expose the patterned mask. The patterned mask is removed and then a portion of the oxidized porous silicon region is removed surrounding the number of emitter tip regions.

Another apparatus embodiment includes a flat panel display. The flat panel display includes a field emitter array which has a number of cathodes formed in rows along a substrate. A gate insulator is formed along the substrate and surrounding the cathodes. A number of gate lines are formed on the gate insulator. A number of anodes are formed in columns orthogonal to and opposing the rows of cathodes in which an intersection of the rows and columns form pixels. The cathodes formed according to a method which includes forming a patterned mask on a silicon substrate to define a number of emitter tip regions. A dopant is implanted into the silicon substrate such that implanting the dopant into the silicon substrate includes defining a more heavily doped region in the silicon substrate surrounding the number of emitter tip regions. The silicon substrate is anodized causing the more heavily doped region to form a porous silicon region and additionally regulating a size for the number of emitter tip regions. The porous silicon region is oxidized to form an oxidized porous silicon surrounding the number of emitter tip regions. The flat panel display further includes a row decoder and a column decoder each coupled to the field emitter array in order to selectively access the pixels. The flat panel display includes a processor which receives input signals and provides the input signals to the row and column decoders. In one exemplary embodiment, the number of gate lines and the number of cathodes are formed using the self-aligned technique.

FIGS. 1A–1D illustrate an embodiment of a process of fabrication of a field emitter device according to the teachings of the present invention. The sequence of process steps can be followed as a method for forming vertical geometries on a silicon substrate, as a method for forming pillars of silicon, and as a method for forming an array of field emitter tips.

FIG. 1A shows the structure after the first sequence of processing steps. A dopant 115 is implanted in a patterned manner into the silicon substrate 110. Implanting the dopant into the silicon substrate 110 in a patterned manner forms a more heavily doped region 120 in the silicon substrate 110 surrounding a number of less heavily doped regions 140. In one embodiment, the doping creates doped hemispherical areas 120 as shown in FIG. 1A. In one embodiment, the less heavily doped regions 140 include un-doped bulk silicon material. In an alternate embodiment, the less heavily doped regions 140 include lightly doped (p-type or n-type) bulk silicon material. In one embodiment of FIG. 1A, implanting a dopant 115 into the silicon substrate 110 includes implanting a p-type dopant 115. In one embodiment, implanting the dopant 115 includes implanting the dopant 115 in a patterned manner into the silicon substrate 110 for a mean dopant distribution at approximately 2,000 Å. One of ordinary skill in the art will understand upon reading this disclosure that the implantation energy level, dopant concentration, and choice of dopant (p-type or n-type) can all be engineered to achieve various implant topographies.

In one exemplary embodiment, implanting the dopant in a patterned manner into the silicon substrate 110 includes defining the number of less heavily doped regions 140 in a pillar geometry 140. In this embodiment the number of less heavily doped regions 140 defines a number of less heavily doped emitter tip regions 140. In one exemplary embodiment, the structure of FIG. 1A undergoes an annealment process to create a uniform distribution of the dopant 115 in the more heavily doped region 120.

Figure 1B:
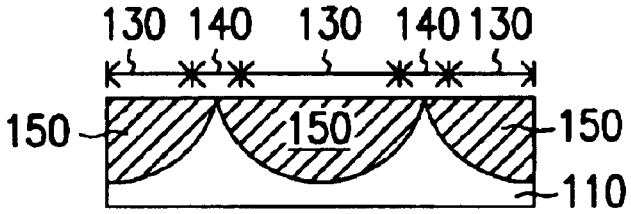

FIG. 1B illustrates the structure following the next sequence of fabrication steps. In FIG. 1B, the silicon substrate 110 is anodized. Anodizing the silicon substrate 110 causes the more heavily doped region 120 to form a porous silicon region 150. One of ordinary skill in the art will understand that there are many chemistries according to which the anodizing may be performed. In one embodiment of the present invention, anodizing the silicon substrate 110 includes placing the silicon substrate 110 in an HF/isopropyl alcohol bath and sourcing the HF/isopropyl alcohol bath in a low current, high voltage process (high voltage being defined in the 20–30 Volts range). In one embodiment, anodizing the silicon substrate 110 includes suspending the silicon substrate 110 in an HF/isopropyl alcohol bath and sourcing a current through the HF/isopropyl alcohol bath by placing two separate electrodes in the bath. In one embodiment, anodizing the silicon substrate 110 includes suspending the silicon substrate in an HF/isopropyl alcohol bath along with multiple wafers in a batch process. Anodizing the silicon substrate 110 further causes a reduction in the size and shape of the number of less heavily doped emitter tip regions 140 based on the anodization parameters.

In one embodiment, anodizing the silicon substrate 110 includes controlling the anodization period. In this embodiment, controlling the anodization period includes regulating a shape to the number of less heavily doped regions 140. In this embodiment, regulating the shape to the number of less heavily doped regions includes defining the number of less heavily doped regions 140 in a conical shape 140. In another embodiment, as shown in FIG. 1B, anodizing the silicon substrate 110 includes reducing a volume of the number of less heavily doped regions 140. In one embodiment, anodizing the silicon substrate 110 includes reducing the size for the number of less heavily doped regions 140. In one embodiment, anodizing the silicon substrate includes anodizing the silicon substrate 110 in a self-limiting manner by maximizing a dopant density in the silicon substrate 110 and minimizing a current density through the silicon substrate 110 in an HF/isopropyl alcohol bath. In one embodiment, anodizing the silicon substrate 110 includes creating a textured surface on the number of less heavily doped regions 140.

Figure 1C:
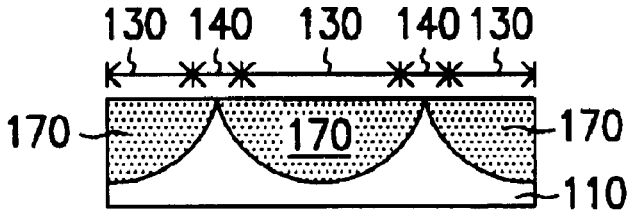

FIG. 1C illustrates the structure following the next series of process steps. FIG. 1C illustrates that one embodiment of the present invention includes forming an insulator layer 170 surrounding the number of less heavily doped regions 140. In FIG. 1C, the silicon substrate 110 is oxidized. Oxidizing the silicon substrate 110 transforms the porous silicon region 150 into an oxidized porous silicon region 170, or oxidized region 170. One of ordinary skill in the art will understand upon reading this disclosure the various methods by which the porous silicon region 150 of FIG. 1B may be oxidized.

Figure 1D:
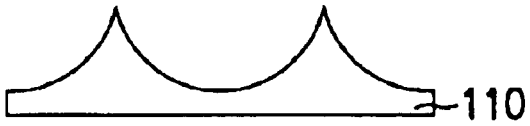

FIG. 1D illustrates the structure following the next series of fabrication steps in order to form an array of field emitter tips. In FIG. 1D the oxidized porous silicon region 170 is removed. In one embodiment, the oxidized porous silicon region 170 is removed using a wet etch process. At this point, the array of field emitter tips can be covered with an insulator layer using a conventional process and a patterned gate layer can be formed on the insulator layer to create a field emitter device.

FIGS. 2A–2F illustrate an embodiment of a process of fabrication of a field emitter device according to the teachings of the present invention. The sequence of process steps can be followed as a method for forming vertical geometries on a silicon substrate, as a method for forming pillars of silicon, and as a method for forming an array of field emitter tips.

Figure 2A:
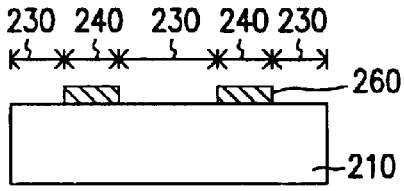
FIGS. 2A–2F illustrate an alternate embodiment of a process of fabrication of a field emitter device according to the teachings of the present invention.

FIG. 2A shows the structure after the first sequence of processing steps. As shown in FIG. 2A, a patterned mask 260 is formed on a silicon substrate 210. Forming the patterned mask 260 includes defining a number of emitter tip regions 240. In one exemplary embodiment of FIG. 2A, forming the patterned mask 260 includes forming multiple islands of silicon nitride having circular geometries 260. In this embodiment, forming the multiple islands of silicon nitride having circular geometries 260 includes controlling the width to height ratio the multiple islands of silicon nitride 260 in order to define a diameter for each of the number field emitter tip regions 240.

Figure 2B:
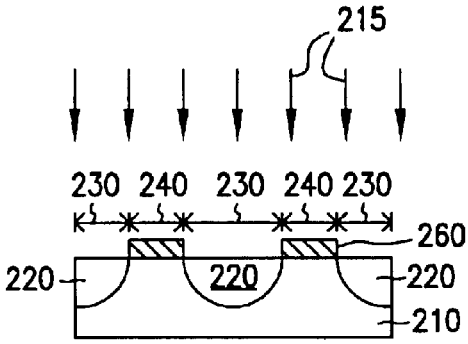

In FIG. 2B, a dopant 215 is implanted into the silicon substrate 210. Implanting the dopant into the silicon substrate 210 forms a more heavily doped region 220 in the silicon substrate 210 surrounding a number of less heavily doped regions 240 which were shield from the implant by the patterned mask 260. In one embodiment, the doping creates doped hemispherical areas 220 as shown in FIG. 2B. In an alternate embodiment, the more heavily doped region 220 may have a different geometrical area 220. In one embodiment, the less heavily doped regions 240 include un-doped bulk silicon material. In an alternate embodiment, the less heavily doped regions 240 include lightly doped (p-type or n-type) bulk silicon material. In one embodiment of FIG. 2B, implanting a dopant 215 into the silicon substrate 210 includes implanting a p-type dopant 215. In one embodiment, implanting the dopant 215 includes implanting the dopant 215 into the silicon substrate 210 for a mean dopant distribution at approximately 2,000 Å. One of ordinary skill in the art will understand upon reading this disclosure that the implantation energy level, dopant concentration, and choice of dopant (p-type or n-type) can all be engineered to achieve various implant topographies 220.

In one exemplary embodiment, implanting the dopant 215 into the silicon substrate 210 includes defining the number of less heavily doped regions 240 in a pillar geometry 240. The number of less heavily doped regions 240 defines a number of less heavily doped emitter tip regions 240. In one exemplary embodiment, the more heavily doped region 220 is annealed in the silicon substrate 210 to create a uniform distribution of the dopant 215 in the more heavily doped region 220.

Figure 2C:
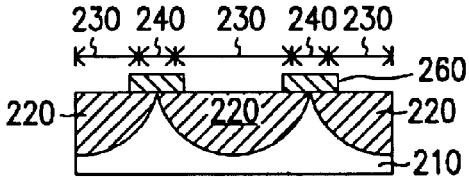

FIG. 2C illustrates the structure following the next sequence of fabrication steps. In FIG. 2C, the silicon substrate 210 is anodized. Anodizing the silicon substrate 210 causes the more heavily doped region 220 to form a porous silicon region 250. One of ordinary skill in the art will understand that there are many chemistries according to which the anodizing may be performed. In one embodiment, the silicon substrate is anodized according to the methods described and presented above in connection with FIG. 1B. Anodizing the silicon substrate 210 further causes a reduction in the size and shape of the number of less heavily doped emitter tip regions 240 based on the anodization parameters.

In one embodiment, anodizing the silicon substrate 210 includes controlling the anodization period. In this embodiment, controlling the anodization period includes regulating a shape to the number of less heavily doped regions 240. In this embodiment, regulating the shape to the number of less heavily doped regions includes defining the number of less heavily doped regions 240 in a conical shape 240. In another embodiment, as shown in FIG. 2C, anodizing the silicon substrate 210 includes reducing a volume of the number of less heavily doped regions 240 underneath the patterned mask 260. In one embodiment, anodizing the silicon substrate 210 includes reducing the size for the number of less heavily doped regions 240. In one embodiment, anodizing the silicon substrate includes anodizing the silicon substrate 210 in a self-limiting manner by maximizing a dopant density in the silicon substrate 210 and minimizing a current density through the silicon substrate 210 in an HF/isopropyl alcohol bath. In one embodiment, anodizing the silicon substrate 210 includes creating a textured surface on the number of less heavily doped emitter tip regions 240.

Figure 2D:
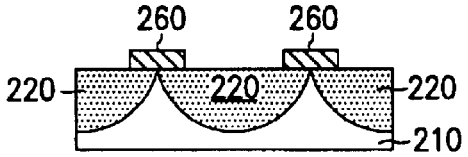

FIG. 2D illustrates the structure following the next series of process steps. FIG. 2D illustrates that one embodiment of the present invention includes forming an insulator layer 270 surrounding the number of less heavily doped regions 240. In FIG. 2D, the silicon substrate 210 is oxidized. Oxidizing the silicon substrate 210 transforms the porous silicon region 250 into an oxidized porous silicon region 270, or oxidized region 270. One of ordinary skill in the art will understand upon reading this disclosure the various methods by which the porous silicon region 250 of FIG. 2D may be oxidized.

Figure 2E:
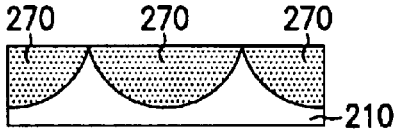

FIG. 2E illustrates the structure following the next series of fabrication steps in order to form an array of field emitter tips. In FIG. 2E, the patterned mask 260 is removed. In one embodiment, the patterned mask 260 is removed using a dry etch process. In an alternate embodiment, the patterned mask 260 is removed using other etching techniques as will be understood by one of ordinary skill in the art upon reading this disclosure.

Figure 2F:
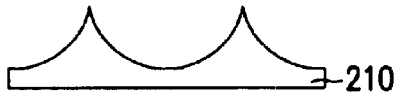

FIG. 2F illustrates the structure following the next series of fabrication steps in order to form an array of field emitter tips. In FIG. 2F the oxidized porous silicon region 270 is removed. In one embodiment, the oxidized porous silicon region 270 is removed using a wet etch process. In an alternate embodiment, the oxidized porous silicon region 270 is removed using other etching techniques as will be understood by one of ordinary skill in the art upon reading this disclosure. At this point, the array of field emitter tips can be covered with an insulator layer using a conventional process and a patterned gate layer can be formed on the insulator layer to create a field emitter device.

Figure 3A:
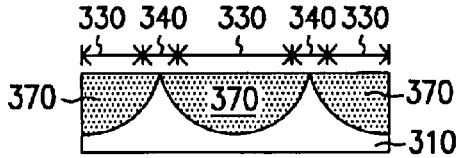
FIGS. 3A–3G illustrate an embodiment of a process for forming a field emission device, according to the teaching of the present invention.

FIGS. 3A–3G illustrate an embodiment of a process for forming a field emission device, according to the teaching of the present invention. FIG. 3A illustrates the structure following the sequence of fabrication steps described and explained above in connection with FIGS. 1A–1C. In the embodiment of FIG. 3A, the structure consists of a silicon substrate 310, an oxidized porous silicon region 370, or oxidized region 370, and a number of field emitter tip regions 340.

Figure 3B:
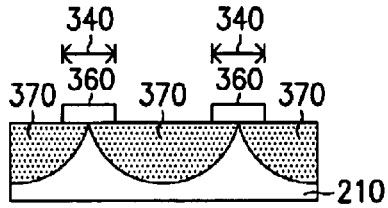

FIG. 3B illustrates the embodiment following the next sequence of processing steps. As shown in FIG. 3B, a patterned mask 360 is formed over the number of field emitter tip regions 340 and portions of the oxidized region 370. In one embodiment, forming the patterned mask 360 includes forming multiple islands of silicon nitride having circular geometries 360. In this embodiment, forming the multiple islands of silicon nitride having circular geometries 360 includes controlling the width to height ratio the multiple islands of silicon nitride 360 in order to define a diameter covering the number field emitter tip regions 340. In one embodiment, the size of the patterned mask 360 is reduced using a dry etch process.

Figure 3C:
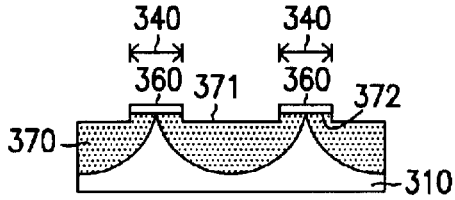

In one exemplary embodiment, shown in FIG. 3C, the size of the patterned mask has been reduced and a portion of the oxidized region 370 is removed by etching back the oxidized region 370 using a dry etch process. In this embodiment, top surface layer 371 of the oxidized region 370 is removed to below a bottom surface 372 of the patterned mask 360. The structure is now as appears in FIG. 3C.

Figure 3D:
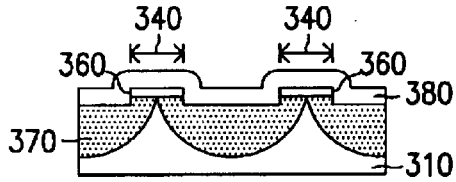

FIG. 3D illustrates the structure following the next series of processing steps. As shown in FIG. 3D, a gate layer 380 is formed over the oxidized region 370 and the patterned mask 360. In one embodiment, forming a gate layer 380 over the oxidized region 370 and the pattern mask 360 includes sputtering a gate layer 380 over the oxidized region 370 and the patterned mask 360. In an alternative embodiment, forming the gate layer 380 on the oxidized region 370 and the patterned mask 360 includes forming a polysilicon gate layer 380. In another alternative embodiment, forming a gate layer 380 on the oxidized region 370 and the patterned mask 360 includes forming a refractory metal layer 380 such as a tungsten (W) gate layer 380. The structure is now as appears in FIG. 3D.

Figure 3E:
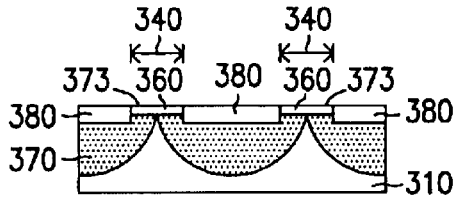

In FIG. 3E the gate layer 380 has been removed from a top surface 373 of the patterned mask 360. In one embodiment, removing the gate layer 380 from the top surface 373 of the patterned mask 360 includes using a chemical mechanical planarization (CMP) process. FIG. 3E illustrates that the patterned mask 360 remains covering the number of emitter tip regions 340.

Figure 3F:
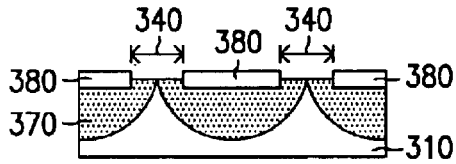

FIG. 3F illustrates the structure following the next series of fabrication steps. In FIG. 3F, the patterned mask 360 is removed from the structure. In one embodiment, the patterned mask 360 is removed from the structure using a dry etch process. In one embodiment, removing the patterned mask 360 includes exposing the oxidized region and a portion of the number of emitter tip regions 340. The structure is now as appears in FIG. 3F.

Figure 3G:
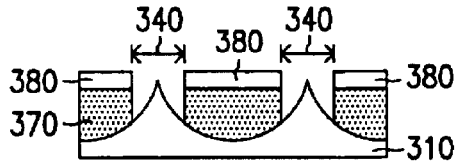

FIG. 3G shows the structure after the next sequence of processing steps. In FIG. 3G, portions of the oxidized region 370 are etched from around the number of emitter tip regions 340. In one embodiment, etching out a portion of the oxidized region 370 surrounding the number of emitter tip regions 340 includes performing a selective dry etch.

Figure 4A:
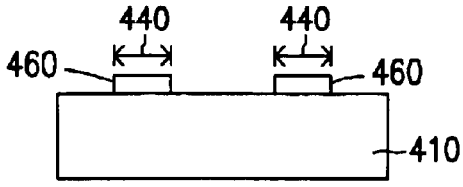
FIGS. 4A–4I illustrate an embodiment of a process for forming a self-aligned gate structure around an array of emitter tips, or a field emission device, according to the teaching of the present invention.

FIGS. 4A–4I illustrate an embodiment of a process for forming a self-aligned gate structure around an array of emitter tips, or a field emission device, according to the teaching of the present invention. As shown in FIG. 4A, a patterned mask 460 is formed on a silicon substrate 410. Forming the patterned mask 460 includes defining a number of emitter tip regions 440. In one exemplary embodiment of FIG. 4A, forming the patterned mask 460 includes forming multiple islands of silicon nitride having circular geometries 460. In this embodiment, forming the multiple islands of silicon nitride having circular geometries 460 includes controlling the width to height ratio the multiple islands of silicon nitride 460 in order to define a diameter for each of the number field emitter tip regions 440.

Figure 4B:
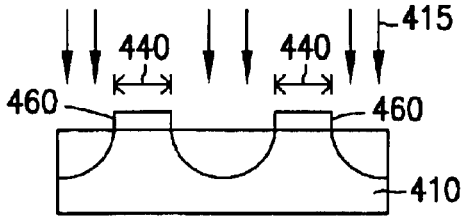

In FIG. 4B, a dopant 415 is implanted into the silicon substrate 410. Implanting the dopant 415 into the silicon substrate 410 forms a more heavily doped region 420 in the silicon substrate 410 surrounding a number of less heavily doped regions 440 which were shielded from the dopant 415 implant by the patterned mask 460. The number of less heavily doped regions also define the number of field emitter tip regions 440. In one embodiment, the doping creates doped hemispherical areas 420 as shown in FIG. 4B. In an alternate embodiment, the more heavily doped region 420 may have a different geometrical area 420. In one embodiment, the less heavily doped regions 440 include un-doped bulk silicon material. In an alternate embodiment, the less heavily doped regions 440 include a lightly doped (p-type or n-type) bulk silicon material. In one embodiment of FIG. 4B, implanting a dopant 415 into the silicon substrate 410 includes implanting a p-type dopant 415. In one embodiment, implanting the dopant 415 includes implanting the dopant 415 into the silicon substrate 410 for a mean dopant distribution at approximately 2,000 Å. One of ordinary skill in the art will understand upon reading this disclosure that the implantation energy level, dopant concentration, and choice of dopant (p-type or n-type) can all be engineered to achieve various implant topographies 420.

In one exemplary embodiment, implanting the dopant 415 into the silicon substrate 410 includes defining the number of less heavily doped regions 440 in a pillar geometry 440. In one exemplary embodiment, the more heavily doped region 420 is annealed in the silicon substrate 410 to create a uniform distribution of the dopant 415 in the more heavily doped region 420.

Figure 4C:
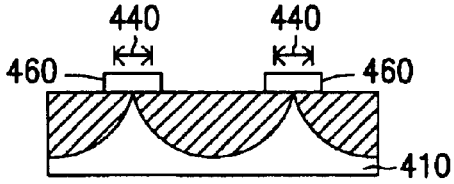

FIG. 4C illustrates the structure following the next sequence of fabrication steps. In FIG. 4C, the silicon substrate 410 is anodized. Anodizing the silicon substrate 410 causes the more heavily doped region 420 to form a porous silicon region 450. One of ordinary skill in the art will understand that there are many chemistries according to which the anodizing may be performed. In one embodiment of the present invention, anodizing the silicon substrate 410 includes placing the silicon substrate 410 in an HF/isopropyl alcohol bath and sourcing the HF/isopropyl alcohol bath in a low current, high voltage process (high voltage being defined in the 20–30 Volts range). In one embodiment, anodizing the silicon substrate 410 includes suspending the silicon substrate 410 in an HF/isopropyl alcohol bath and sourcing a current through the HF/isopropyl alcohol bath by placing two separate electrodes in the bath. In one embodiment, anodizing the silicon substrate 410 includes suspending the silicon substrate in an HF/isopropyl alcohol bath along with multiple wafers in a batch process. Anodizing the silicon substrate 410 further causes a reduction in the size and shape of the number of less heavily doped emitter tip regions 440 based on the anodization parameters.

In one embodiment, anodizing the silicon substrate 410 includes controlling the anodization period. In this embodiment, controlling the anodization period includes regulating a shape to the number of less heavily doped regions 440. In this embodiment, regulating the shape to the number of less heavily doped regions includes defining the number of less heavily doped regions 440 in a conical shape 440. In another embodiment, as shown in FIG. 4C, anodizing the silicon substrate 410 includes reducing a volume of the number of less heavily doped regions 440 underneath the patterned mask 460. In one embodiment, anodizing the silicon substrate 410 includes reducing the size for the number of less heavily doped regions 440. In one embodiment, anodizing the silicon substrate includes anodizing the silicon substrate 410 in a self-limiting manner by maximizing a dopant density in the silicon substrate 410 and minimizing a current density through the silicon substrate 410 in an HF/isopropyl alcohol bath. In one embodiment, anodizing the silicon substrate 410 includes creating a textured surface on the number of less heavily doped emitter tip regions 440.

Figure 4D:
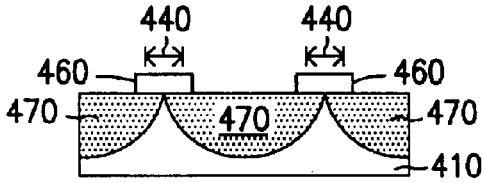

FIG. 4D illustrates the structure following the next series of process steps. FIG. 4D illustrates forming an insulator layer 470 surrounding the number of less heavily doped regions 440. In FIG. 4D, the silicon substrate 410 is oxidized. Oxidizing the silicon substrate 410 transforms the porous silicon region 450 into an oxidized porous silicon region 470, or oxidized region 470. One of ordinary skill in the art will understand upon reading this disclosure the various methods by which the porous silicon region 450 of FIG. 4D may be oxidized.

Figure 4E:
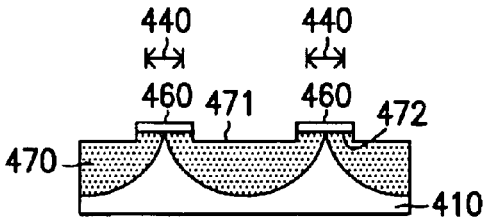

FIG. 4E illustrates the embodiment following the next sequence of processing steps. In one embodiment, the size of the pattern mask 460 is reduced. In this embodiment reducing the size of the patterned mask 460 includes using a dry etch process. In the embodiment shown in FIG. 4E, a portion of the oxidized region 470 is removed by etching back the oxidized region 470 using a dry etch process. In this embodiment, top surface layer 471 of the oxidized region 470 is removed to below a bottom surface 472 of the patterned mask 460. The structure is now as appears in FIG. 4E.

Figure 4F:
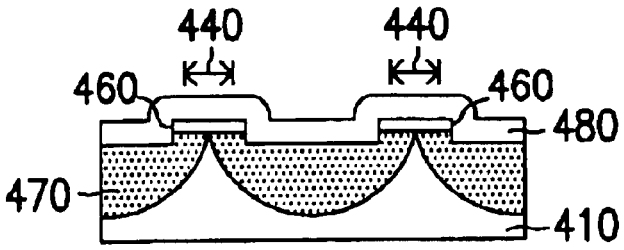

FIG. 4F illustrates the structure following the next series of processing steps. As shown in FIG. 4F, a gate layer 480 is formed over the oxidized region 470 and the patterned mask 460. In one embodiment, forming a gate layer 480 over the oxidized region 470 and the pattern mask 460 includes sputtering a gate layer 480 over the oxidized region 470 and the patterned mask 460. In an alternative embodiment, forming the gate layer 480 on the oxidized region 470 and the patterned mask 460 includes forming a polysilicon gate layer 480. In another alternative embodiment, forming a gate layer 480 on the oxidized region 470 and the patterned mask 460 includes forming a refractory metal layer 480 such as a tungsten (W) gate layer 480. The structure is now as appears in FIG. 4F.

Figure 4G:
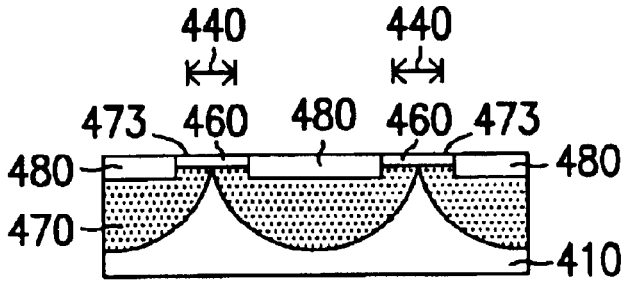

In FIG. 4G the gate layer 480 has been removed from a top surface 473 of the patterned mask 460. In one embodiment, removing the gate layer 480 from the top surface 473 of the patterned mask 460 includes using a chemical mechanical planarization (CMP) process. FIG. 4G illustrates that the patterned mask 460 is still covering the number of less heavily doped emitter tip regions 440.

Figure 4H:
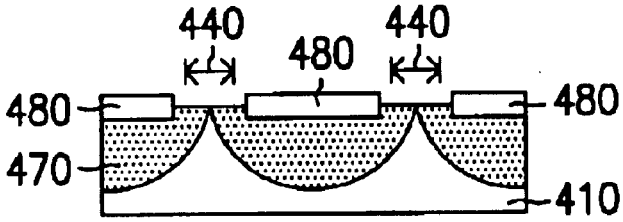

FIG. 4H illustrates the structure following the next series of fabrication steps. In FIG. 4H, the patterned mask 460 is removed from the structure. In one embodiment, the patterned mask 460 is removed from the structure using a dry etch process. In one embodiment, removing the patterned mask 460 includes exposing the oxidized region and a portion of the number of less heavily doped emitter tip regions 440. The structure is now as appears in FIG. 4I.

Figure 4I:
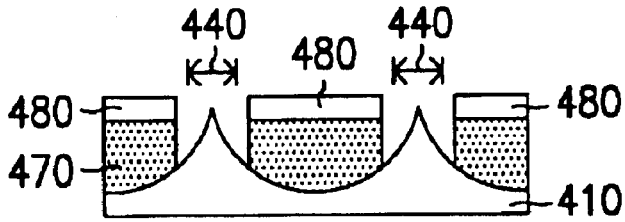

FIG. 4I shows the structure after the next sequence of processing steps. In FIG. 4I, portions of the oxidized region 470 are etched from around the number of less heavily doped emitter tip regions 440. In one embodiment, etching out a portion of the oxidized region 470 surrounding the number of less heavily doped emitter tip regions 440 includes performing a selective dry etch.

Figure 5:
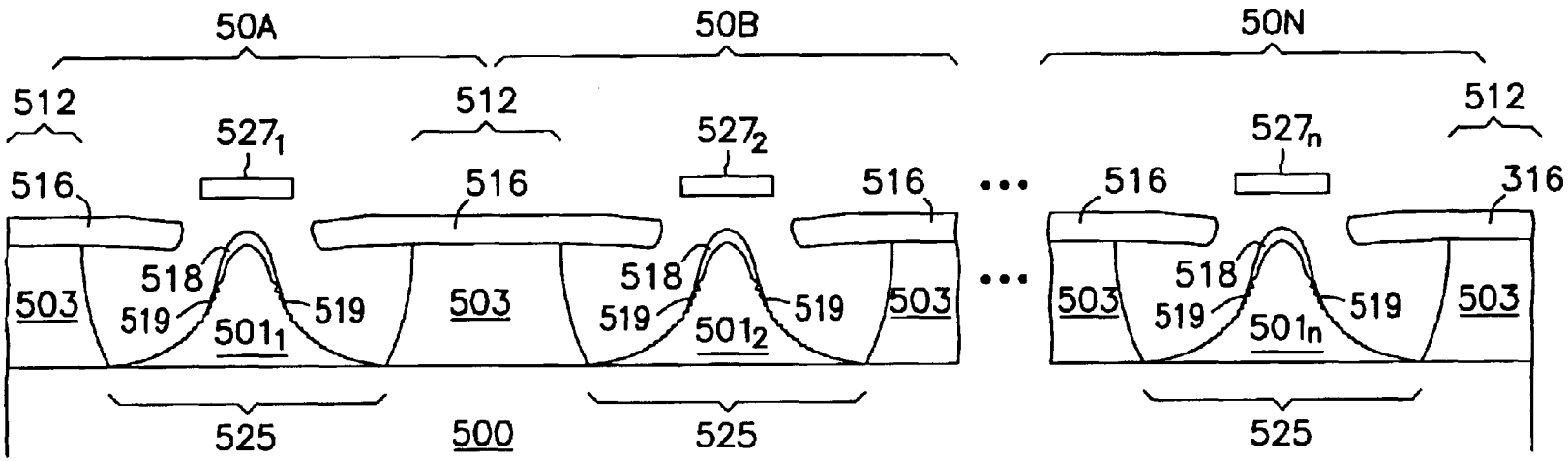
FIG. 5 is a planar view of an embodiment of a portion of an array of field emitters according to the teachings of the present invention.

FIG. 5 is a planar view of an embodiment of a portion of an array of field emitters, 50A, 50B, . . . 50N, constructed according to the teachings of the present invention. The array of field emitters, 50A, 50B, . . . 50N, includes a number of cathodes, $\mathbf{501}_1$, $\mathbf{501}_2$, . . . $\mathbf{501}_n$ formed in rows along a substrate 500. A gate insulator 503 is formed along the substrate 500 and surrounds the number of cathodes, $\mathbf{501}_1$, $\mathbf{501}_2$, . . . $\mathbf{501}_n$. A number of gate lines, shown in FIG. 5 as 516, are formed on the gate insulator 503. A number of anodes, $\mathbf{527}_1$, $\mathbf{527}_2$, . . . $\mathbf{527}_n$ are formed in columns orthogonal to and opposing the rows of cathodes, $\mathbf{501}_1$, $\mathbf{501}_2$, . . . $\mathbf{501}_n$. The number of anodes, $\mathbf{527}_1$, $\mathbf{527}_2$, . . . $\mathbf{527}_n$ are formed on another substrate (not shown) which opposes number of cathodes, $\mathbf{501}_1$, $\mathbf{501}_2$, . . . $\mathbf{501}_n$ formed in rows along a substrate 500. The number of anodes, $\mathbf{527}_1$, $\mathbf{527}_2$, . . . $\mathbf{527}_n$ may each include multiple phosphors for each of the number of cathodes, $\mathbf{501}_1$, $\mathbf{501}_2$, . . . $\mathbf{501}_n$. Alternatively, each of the number of anodes, $\mathbf{527}_1$, $\mathbf{527}_2$, . . . $\mathbf{527}_n$ may have a single phosphor such that each of the number of anodes, $\mathbf{527}_1$, $\mathbf{527}_2$, . . . $\mathbf{527}_n$ is paired with one of the number of cathodes, $\mathbf{501}_1$, $\mathbf{501}_2$, . . . $\mathbf{501}_n$ The intersection of the rows of cathodes, $\mathbf{501}_1$, $\mathbf{501}_2$, . . . $\mathbf{501}_n$ and the columns of anodes, $\mathbf{527}_1$, $\mathbf{527}_2$, . . . $\mathbf{52}_n$ form pixels.

Each field emitter in the array, 50A, 50B, . . . , 50N, is constructed in a similar manner according to any one of the methods presented in this application. Thus, only one field emitter device 50N is described herein in detail. All of the field emitter devices are formed along the surface of a substrate 500. In one embodiment, the substrate includes a lightly doped silicon substrate 500 originating from a bulk lightly doped silicon wafer.

Field emitter device 50N includes a cathode $\mathbf{501}_n$ formed in a cathode region $\mathbf{525}_n$ of the substrate 500. In one embodiment, the cathode $501_n$ includes a lightly doped emitter tip $501_n$. In one embodiment, the cathode $501_n$ has a pillar geometry. In another embodiment, shown in FIG. 5, the cathode $501_n$ has a conical shape and a textured surface 519 resulting from the anodization process detailed and described previously. The cathode $501_n$ can be formed according to any of the methods described and presented in detail above in connection with FIGS. 1, 2, 3, or 4. In the embodiment of FIG. 5, the cathode $501_n$ includes a surface layer 518 formed on the cathode $501_n$ in order to decrease the work function between the cathode $501_n$ and the number of gate lines 516. The surface layer 518 can include a metal silicide 518 selected from any one of a number of refractory metals, e.g. molybdenum (Mo), tungsten (W), or titanium (Ti). The surface layer 518 can similarly include any other exotic compound designed to lower the work function between the cathode $501_n$ and the number of gate lines 516. In one embodiment, the surface layer 518 is deposited on the cathode $501_n$, by a process such as chemical vapor deposition (CVD). The surface layer 518 may also undergo a rapid thermal anneal (RTA) to form a silicide 518.

A gate insulator 503 is formed in an isolation region 512 of the substrate 500. The gate insulator 503 is a porous oxide layer 503 formed according to the anodization and oxidation methods described and presented above in connection with FIGS. 1, 2, 3, or 4. As described above, controlling the anodization period and forming the porous oxide layer 503 includes defining, or regulating the shape and size of the number of cathodes, $501_1$, $501_2$, . . . $501_n$.

A gate 516 is formed on the gate insulator 503. In one embodiment, the gate 516 is formed by sputtering a gate layer 516 on the gate insulator 503. In another embodiment, the gate layer 516 is formed of a refractory metal 516. In still another embodiment of the present invention, the gate layer 516 is a polycide formed from a polysilicon gate layer 516 and a refractory metal, e.g. molybdenum (Mo). In an alternate embodiment, the gate 516 is formed of other suitable conductors.

In one embodiment of the present invention, the gate 516 is patterned and formed independent of the number of cathodes, $501_1$, $501_2$, . . . $501_n$ as discussed above in connection with FIG. 3. In another embodiment, the gate 516 and the number of cathodes, $501_1$, $501_2$, . . . $501_n$ are formed using a self-aligned technique as discussed above in connection with FIG. 4. In one operational embodiment, the array of field emitters, 50A, 50B, . . . 50N, can directly excite phosphor targets on the number of anodes, $527_1$, $527_2$, . . . $527_n$ with electrons emitted from the number of cathodes, $501_1$, $501_2$, . . . $501_n$. In an alternate operational embodiment, the array of field emitters, 50A, 50B, . . . 50N, can indirectly excite phosphor targets on the number of anodes, $527_1$, $527_2$, . . . $527_n$. In this embodiment, electrons emitted from the number of cathodes, $501_1$, $501_2$, . . . $501_n$ excite a trapped gas creating ultraviolet light (photons) which impart energy to the phosphors on the number of anodes, $527_1$, $527_2$, . . . $527_n$. The phosphors then re-emit visible light.

Figure 6:
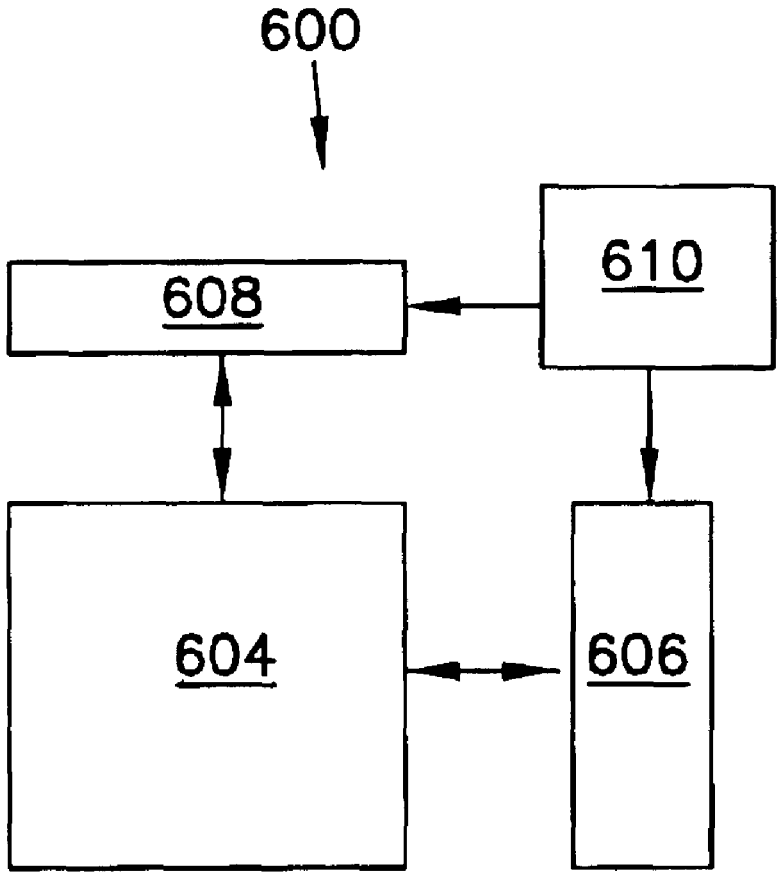
FIG. 6 is a block diagram which illustrates an embodiment of a display device, or system, according to the teachings of the present invention.

FIG. 6 is a block diagram which illustrates an embodiment of a display device, or system 600 according to the teachings of the present invention. The display device includes a field emitter array 604 formed on a silicon substrate. The field emitter array 604 includes the field emitter array described and presented above in connection with FIGS. 3 and 4. A row decoder 606 and a column decoder 608 each couple to the field emitter array 604 in order to selectively access the field emitter array 604. Further, a processor 610 is included which receives input signals and provides the input signals to address the row and column decoders, 606 and 608 respectively.

CONCLUSION

Thus, improved methods and structures are provided for an array of vertical geometries which may be used as emitter tips, as a self aligned gate structure surrounding field emitter tips, or as part of a flat panel display. The present invention offers controlled size in emitter tip formation included within a more streamlined process. The present invention further provides a more efficient method to control the gate to emitter tip proximity in field emission devices. The novel method of the present invention includes implanting a dopant in a patterned manner into the silicon substrate thereby defining a more heavily doped region in the silicon substrate. The method includes anodizing the silicon substrate in a controlled manner causing the more heavily doped region in the silicon substrate to form a porous silicon region. Controlling the anodization of the silicon substrate further regulates and defines the shape to less heavily doped regions in the silicon substrate which form vertical geometries that can be used as emitter tips. The method includes oxidizing the porous silicon region to form an oxidized porous silicon region and removing the oxidized region.

In another embodiment, a method provides a self-aligned gate structure around emitter tips. Another embodiment of the present invention includes forming a field emission device. The present invention further includes a novel field emitter array, self aligned gate structure, field emission device, and display device all formed according to the methods provided in this application.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. An emitter tip array, comprising:

a number of vertical geometries on a silicon substrate, wherein the number of vertical geometries are formed by a method comprising:

implanting a P-type dopant in a patterned manner into a silicon substrate, wherein implanting a P-type dopant in a patterned manner includes using a mask structure to define a more heavily P-type doped region in the silicon substrate surrounding a number of less heavily doped emitter tip regions;

anodizing the silicon substrate, wherein anodizing the silicon substrate causes the more heavily doped region to form a porous silicon region, oxidizing the porous silicon region to form an oxidized porous silicon region;

removing a portion of the oxidized porous silicon region; and a number of gate structures adjacent to the number of vertical geometries, wherein the mask structure self aligns the gate structures with the number of vertical geometries.

2. The emitter tip array of claim 1, wherein the number of less heavily doped emitter tip regions have a pillar geometry.

3. The emitter tip array of claim 1, wherein the more heavily doped region in the silicon substrate includes a more heavily doped p-type region with a mean dopant distribution at approximately 2000 Angstroms.

4. The emitter tip array of claim 1, wherein the number of less heavily doped emitter tip regions have a textured surface.

5. A self aligned gate structure surrounding field emitter tips, comprising:

a number of emitter tips, wherein the emitter tips arc formed by a method comprising:

forming a patterned mask on a silicon substrate, wherein forming the patterned mask includes defining a number of emitter tip regions;

implanting a P-type dopant into the silicon substrate, wherein implanting a P-type dopant into the silicon substrate includes defining a more heavily P-type doped region in the silicon substrate surrounding the number of emitter tip regions;

anodizing the silicon substrate, wherein anodizing the silicon substrate causes the more heavily doped region to form a porous silicon region, and wherein anodizing the silicon substrate includes reducing a size for the number of emitter tip regions;

oxidizing the porous silicon region to form a porous silicon oxide region; and a gate layer formed on the porous silicon oxide region, wherein the patterned mask self aligns the gate layer with the number of vertical geometries.

6. The self aligned gate structure surrounding field emitter tips of claim 5, wherein the number of emitter tip regions have a pillar geometry.

7. The self aligned gate structure surrounding field emitter tips of claim 5, wherein the gate layer includes a refractory metal gate layer.

8. The self aligned gate structure surrounding field emitter tips of claim 5, wherein the gate layer includes a sputtered gate layer.

9. The self aligned gate structure surrounding field emitter tips of claim 5, wherein the more heavily doped region in the silicon substrate includes a p-type dopant with a mean dopant distribution at approximately 2000 Angstroms.

10. The self aligned gate structure surrounding field emitter tips of claim 5, wherein the number of emitter tip regions have a textured surface.

11. A self aligned gate structure surrounding field emitter tips, comprising:

a number of emitter tips, wherein the emitter tips are formed by a method comprising:

forming a patterned mask on a P-type silicon substrate, wherein forming the patterned mask includes defining a number of emitter tip regions;

implanting a dopant into the P-type silicon substrate, wherein implanting a dopant into the P-type silicon substrate includes defining a more heavily doped region in the P-type silicon substrate surrounding the number of emitter tip regions;

anodizing the P-type silicon substrate, wherein anodizing the P-type silicon substrate causes the more heavily doped region to form a porous silicon region;

oxidizing the porous silicon region to form a porous silicon oxide region; and a gate layer formed on the porous silicon oxide region, wherein the gate layer is formed by a method comprising:

removing a portion of the porous silicon oxide region such that a top surface layer of the porous silicon oxide region is below a bottom surface of the patterned mask;

forming a conductive layer on the porous silicon oxide region and the patterned mask;

removing a portion of the conductive layer to expose the patterned mask;

removing the patterned mask; and removing a portion of the porous silicon oxide region surrounding the number of emitter tip regions.

12. The self aligned gate structure surrounding field emitter tips of claim 11, wherein the number of emitter tip regions have a conical geometry.

13. The self aligned gate structure surrounding field emitter tips of claim 11, wherein the conductive layer includes a polysilicon layer.

14. The self aligned gate structure surrounding field emitter tips of claim 11, wherein the number of emitter tip regions have a textured surface.

15. A display device, comprising:

a field emitter array, wherein the field emitter array includes:

a number of cathodes formed in rows along a substrate;

a gate insulator formed along the substrate and surrounding the cathodes;

a number of self aligned gate lines formed on the gate insulator;

a number of anodes formed in columns orthogonal to and opposing the rows of cathodes, wherein the intersection of the rows and columns form pixels, the cathodes formed by a method comprising:

forming a patterned mask on a silicon substrate, wherein the patterned mask defines a number of emitter tip regions and aligns a portion of the gate lines with the emitter tip regions;

implanting a P-type dopant into the silicon substrate, wherein implanting a P-type dopant into the silicon substrate includes defining a more heavily P-type doped region in the silicon substrate surrounding the number of emitter tip regions;

anodizing the silicon substrate, wherein anodizing the silicon substrate causes the more heavily doped region to form a porous silicon region; and oxidizing the porous silicon region to form an oxidized porous silicon surrounding the number of emitter tip regions;

a row decoder and a column decoder each coupled to the field emitter array in order to selectively access the pixels; and a processor adapted to receiving input signals and providing the input signals to the row and column decoders.

16. The display device of claim 15, wherein the number of cathodes include a low work function surface layer on the emitter tips.

17. The display device of claim 15, wherein the number of gate lines include refractory metals.

18. A display device, comprising:

a field emitter array, wherein the field emitter array includes:

a number of cathodes formed in rows along a substrate;

a gate insulator formed along the substrate and surrounding the cathodes;

a number of anodes formed in columns orthogonal to and opposing the rows of cathodes, wherein the intersection of the rows and columns form pixels, the cathodes formed by a method comprising:

forming a patterned mask on a silicon substrate, wherein the patterned mask defines a number of emitter tip regions;

implanting a P-type dopant into the silicon substrate, wherein implanting a P-type dopant into the silicon substrate includes defining a more heavily doped region in the ilicon substrate surrounding the number of emitter tip regions;

anodizing the silicon substrate, wherein anodizing the silicon substrate causes the more heavily doped region to form a porous silicon region; and oxidizing the porous silicon region to form an oxidized porous silicon surrounding the number of emitter tip regions;

a number of gate lines formed on the gate insulator, wherein the number of gate lines are formed by a method comprising:

removing a portion of the oxidized porous silicon such that a top surface layer of the oxidized porous silicon is below a bottom surface of the patterned mask;

forming a conductive layer on the oxidized porous silicon and the patterned mask;

removing a portion of the conductive layer to expose the patterned mask;

removing the patterned mask; and removing a portion of the oxidized porous silicon surrounding the number of emitter tip regions;

a row decoder and a column decoder each coupled to the field emitter array in order to selectively access the pixels; and a processor adapted to receiving input signals and providing the input signals to the row and column decoders.

19. A field emitter cell, comprising:

a lightly P-type doped silicon pillar on a substrate;

an etched area surrounding the pillar;

a porous silicon oxide material surrounding the etched area, the porous silicon oxide including a higher P-type dopant concentration than the lightly doped silicon pillar; and a self aligned gate structure that is formed using a mask that also defines the lightly doped silicon pillar.

20. A field emitter cell, comprising:

a field emitter tip;

a porous dielectric layer surrounding the field emitter tip, the porous dielectric layer including a higher P-type dopant concentration than the field emitter tip; and a gate structure adjacent to the field emitter tip.

21. The field emitter cell of claim 20, wherein the porous dielectric layer includes porous silicon dioxide.

22. The field emitter cell of claim 20, wherein the gate structure includes a refractory metal gate structure.

23. The field emitter cell of claim 22, wherein the refractory metal gate structure includes a tungsten gate structure.

* * * * *